United States Patent [19]

Higdon

[11] Patent Number: 4,458,704

[45] Date of Patent: Jul. 10, 1984

[54] APPARATUS FOR PROCESSING SEMICONDUCTOR WAFERS

[75] Inventor: William R. Higdon, Eagle, Id.

[73] Assignee: Xertronix, Inc., Rochester, N.Y.

[21] Appl. No.: 437,686

[22] Filed: Oct. 29, 1982

[51] Int. Cl.[3] ..... B08B 3/02

[52] U.S. Cl. ..... 134/57 R; 134/140; 134/153; 134/200; 156/345

[58] Field of Search ..... 134/140, 149, 153, 159, 134/200, 57 R; 156/345

[56] References Cited

U.S. PATENT DOCUMENTS

| | | | |
|---|---|---|---|
| 2,225,501 | 12/1940 | Lapham et al. | 134/149 X |
| 2,503,556 | 4/1950 | McCargar | 134/153 |
| 3,383,255 | 5/1968 | Rossi et al. | 156/345 X |
| 3,464,429 | 9/1969 | Ehrhardt | 134/140 |
| 3,489,608 | 1/1970 | Jacobs et al. | 134/149 X |
| 3,760,822 | 9/1973 | Evans | 134/149 X |
| 3,808,065 | 4/1974 | Robinson et al. | 156/345 X |
| 3,964,957 | 6/1976 | Walsh | 134/159 X |
| 3,970,471 | 7/1976 | Bankes et al. | 134/153 X |
| 3,974,797 | 8/1976 | Hutson | 134/153 X |
| 3,990,462 | 11/1976 | Elftmann et al. | 134/140 X |
| 4,027,686 | 6/1977 | Shortes et al. | 134/153 X |
| 4,077,416 | 3/1978 | Johnson, Jr. et al. | 134/159 |
| 4,078,943 | 3/1978 | Saurenman | 134/25 R X |
| 4,092,176 | 5/1978 | Kozai et al. | 134/186 |
| 4,132,567 | 1/1979 | Blackwood | 134/153 X |
| 4,300,581 | 11/1981 | Thompson | 134/57 R |

FOREIGN PATENT DOCUMENTS

| | | | |
|---|---|---|---|
| 480252 | 4/1916 | France | 134/153 |

*Primary Examiner*—Robert L. Bleutge

[57] ABSTRACT

Apparatus for processing semiconductor wafers is described as having a rotor mounted on a horizontal axis with support bearings at each end of the rotor. Wafers are arranged in a carrier which can be loaded and unloaded into the rotor of the apparatus through an access opening which is directed in a generally upward position when the rotor is stopped. Control means provide for automatic stopping of the rotor in a correct position for unloading and reloading at the end of each processing cycle.

9 Claims, 7 Drawing Figures

APPARATUS FOR PROCESSING SEMICONDUCTOR WAFERS

BACKGROUND OF INVENTION

1. Field of Invention

This invention relates to apparatus especially designed for processing semiconductor wafers or similar disc-shaped objects. More specifically, the invention is concerned with providing an improved apparatus which permits easier or automated loading and unloading of carriers into and out of such apparatus for increasing productivity and quality of the processing carried on within the apparatus.

2. Description of Prior Art

It is known in the art of processing semiconductor wafers to provide for various forms of apparatus which allow the wafers to be coated, etched, cleaned, or dried, prior to eventual use of the wafers in the production of integrated circuits. Early efforts for treating wafers in these various ways involved the treatment of only a single wafer at a time, as shown for example in U.S. Pat. No. 4,027,686 or the treatment of a number of wafers in a stationary tub as shown, for example, in U.S. Pat. No. 4,092,176. Other developments included arrangements for spinning a plurality of wafers within a controlled environment so that multiple processing steps (such as washing with deionized water and drying with nitrogen gas) could be carried out during a single cycle of operations in a single apparatus. Representative patents showing this approach include U.S. Pat. Nos. 3,970,471; 4,132,567; and 4,300,581.

At the present time there appears to be a preference for processing a plurality of wafers in standard-sized plastic carriers which are used for holding and protecting wafers while they are being transported and processed. U.S. Pat. No. 4,300,581 discloses a type of apparatus designed to receive such standard carriers through an end opening of a rotor mounted within a stationary tub. The arrangement shown in U.S. Pat. No. 4,300,581 provides for a tilted axis of rotation which is described as solving a problem of liquid being retained between wafers because of surface tension. However, it is also stated in the same patent that horizontal loading of apparatus of this type is more desirable than loading on a vertical axis.

SUMMARY OF THE INVENTION

The present invention provides for an improvement in the type of semiconductor wafer processing apparatus which is designed to receive standard wafer carriers and to spin those carriers with their retained wafers on a horizontal axis while carrying out coating, etching, washing, or drying operations within the apparatus. The present invention also recognizes the advantages in being able to place loaded carriers into an apparatus without having to orient the carriers in a way which might result in damage or spilling of wafers while the loading is taking place. However, unlike prior art arrangements, the present invention provides for the loading of a carrier into a rotor through an access opening which does not interrupt or interfere with the use of bearing supports at each end of the rotor.

In accordance with the present invention, a rotor is securely and precisely mounted for rotation on a generally horizontal axis and is provided with supporting bearings at each of its ends so that no unbalanced conditions will be created within the rotor while it is being rotated. With this arrangement a longer rotor can be constructed for holding more than one carrier while also permitting the processing only a single carrier without creating an unbalanced condition in the rotor as the wafers are being processed.

In order to provide for loading and unloading of a rotor which is fully supported at each of its ends, an access opening is provided through a wall of the rotor, and the access opening is directed in a generally upward position when the rotor is stopped at the end of a cycle. Control means are provided for stopping the rotor in a correct position for loading and unloading. The control means include a control plate mounted for rotation with the rotor, and the control plate has an opening formed in it for receiving a locking pin when the control plate and the rotor are in positions for directing the access opening of the rotor in a generally upward position. In addition, control circuitry and a program are provided for dictating a processing cycle which includes (a) a very slow rotation of the rotor at the end of each cycle and (b) an actuation of the locking pin during the period of very slow rotation so that the locking pin can enter the opening in the control plate and effectively stop all rotation of the rotor at the end of the cycle. In this manner, there is provided a positive mechanism and control for assuring the correct orientation of the access opening of the rotor for loading and unloading purposes.

In an actual embodiment of the invention, the rotor is positioned and driven within a housing which is also provided with an access opening for providing entry to the rotor within the housing. The first access opening of the rotor and the second access opening of the housing are each provided with respective closure means for closing the rotor and sealing the housing during operations. The closure means for the rotor includes a mechanism for automatically opening the closure at the end of each operating cycle. This permits rapid and automated unloading and reloading of the apparatus.

By providing for an upwardly directed access opening into the rotor, the apparatus of this invention lends itself very well to completely automated facilities which utilize robots or transfer equipment for loading, unloading and transporting carriers of wafers between processing stations. Access through the tops of housings of apparatus associated with the various stations provide for very suitable access which maintains each carrier in a preferred orientation and eliminates risk of damage or spillage to wafers while they are being handled and processed.

Although this invention will be described with reference to a specific application in the processing of semiconductor wafers, it can be appreciated that the apparatus of the invention can be used for other similar purposes for any disc-shaped objects which are placed within a carrier for processing.

BRIEF DESCRIPTIONS OF THE DRAWINGS

DETAILED DESCRIPTION OF THE INVENTION AND OF A PREFERRED EMBODIMENT

Figure 1:
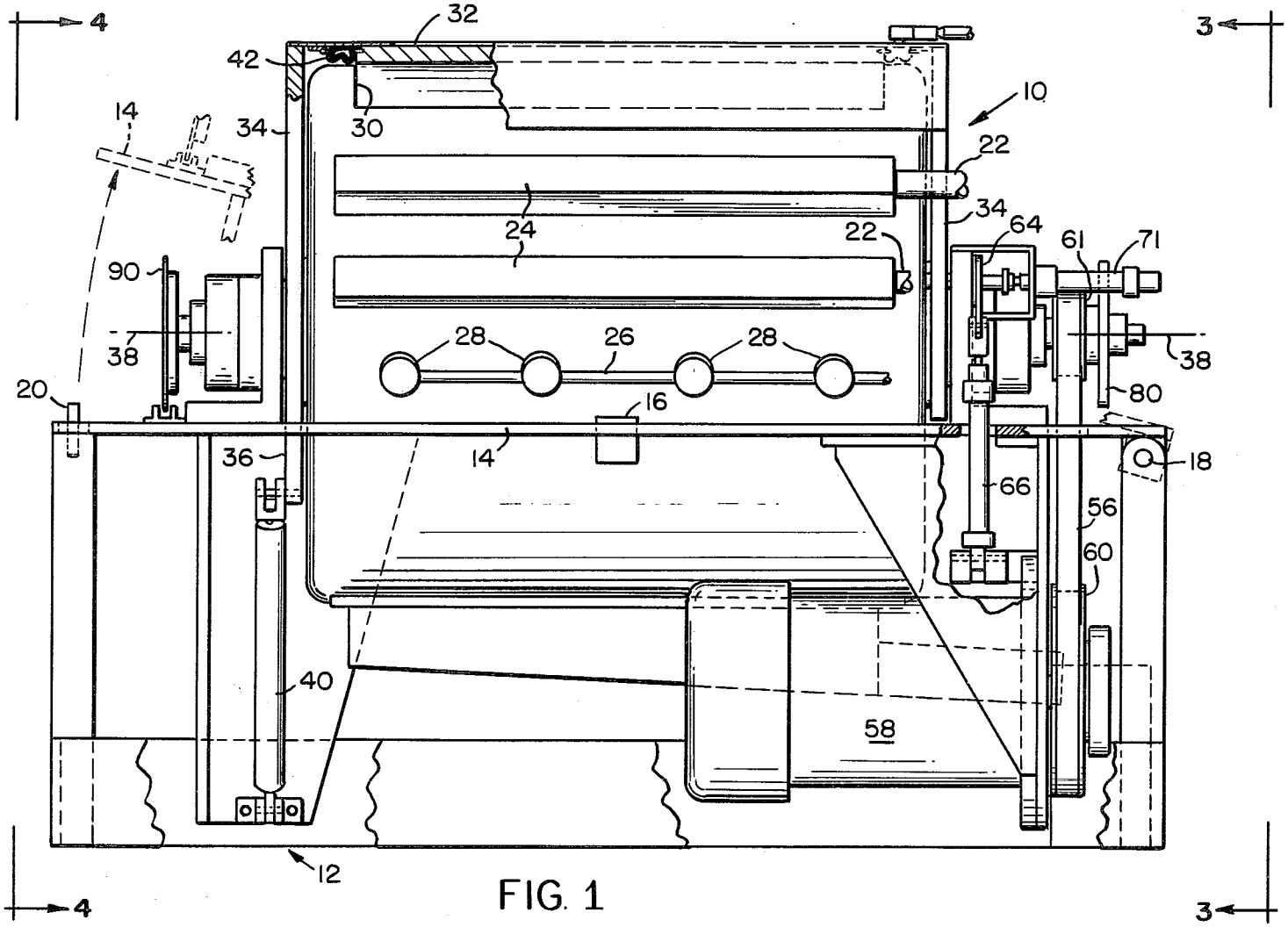
FIG. 1 is a side elevational view of the apparatus of the present invention.
Figure 2:
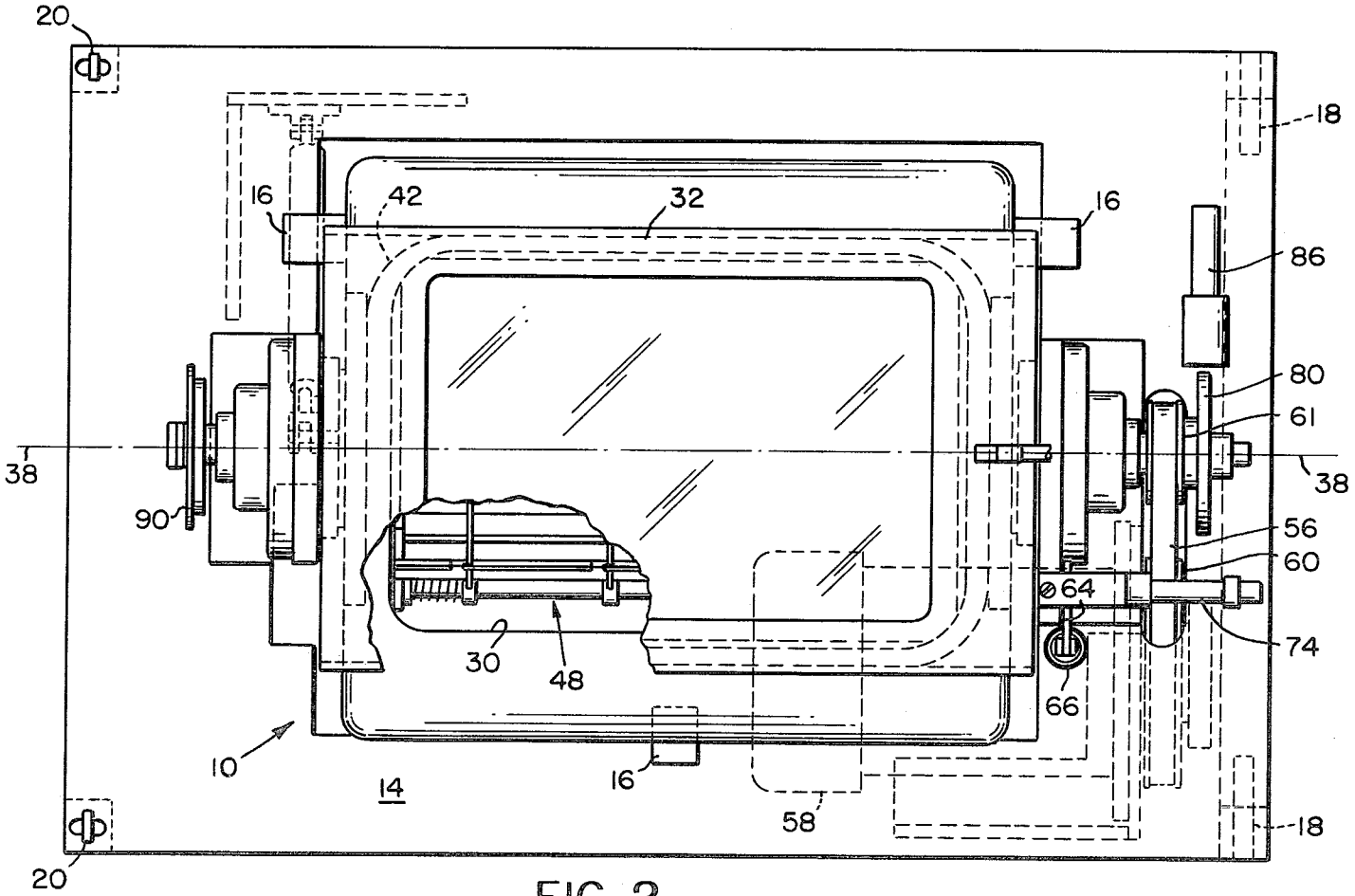
FIG. 2 is a top view, in the same scale as FIG. 1, looking down on the apparatus shown in FIG. 1.
Figure 3:
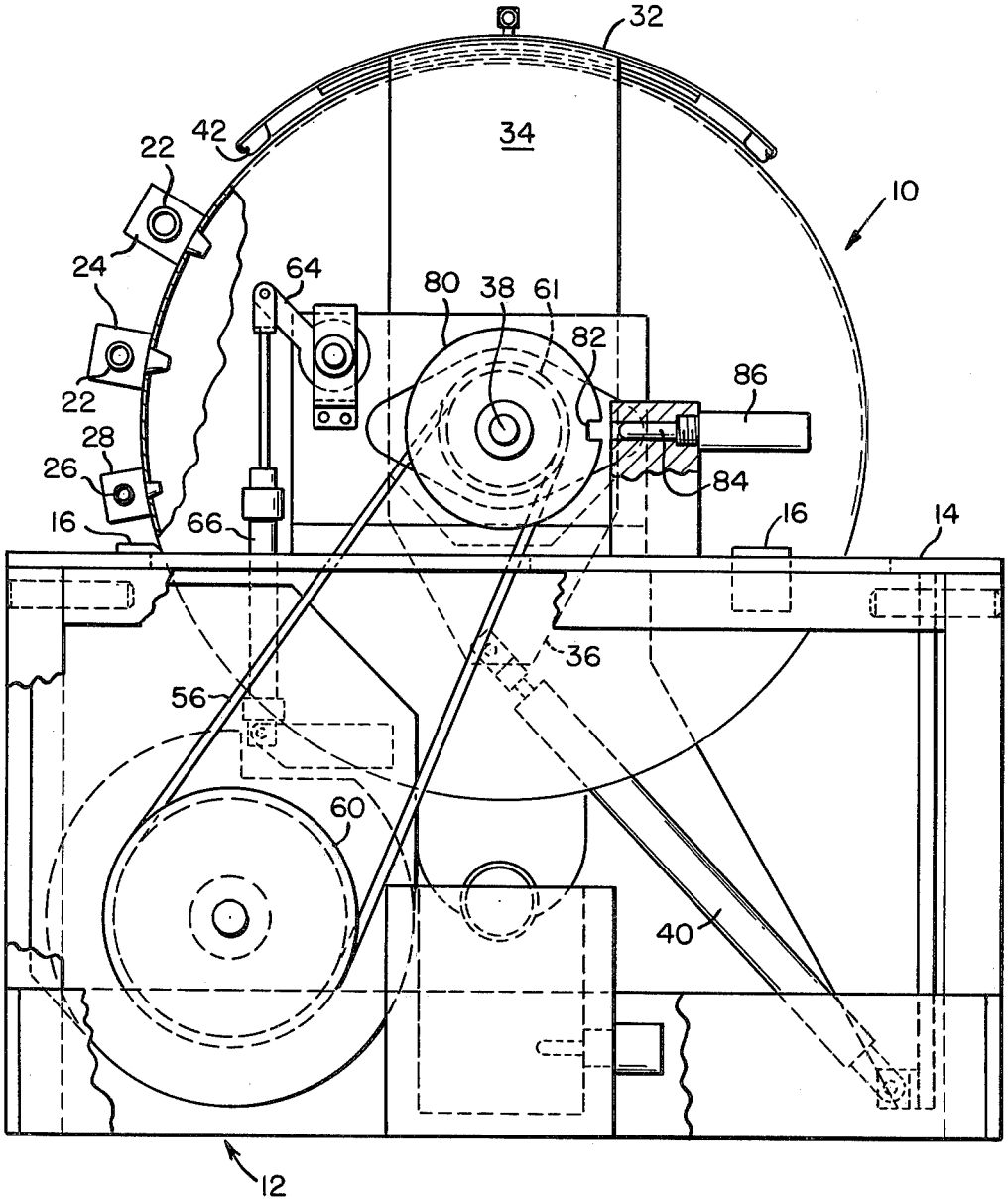
FIG. 3 is an end elevational view of the apparatus shown in FIG. 1, as seen in enlarged scale on lines 3—3 of FIG. 1.
Figure 4:
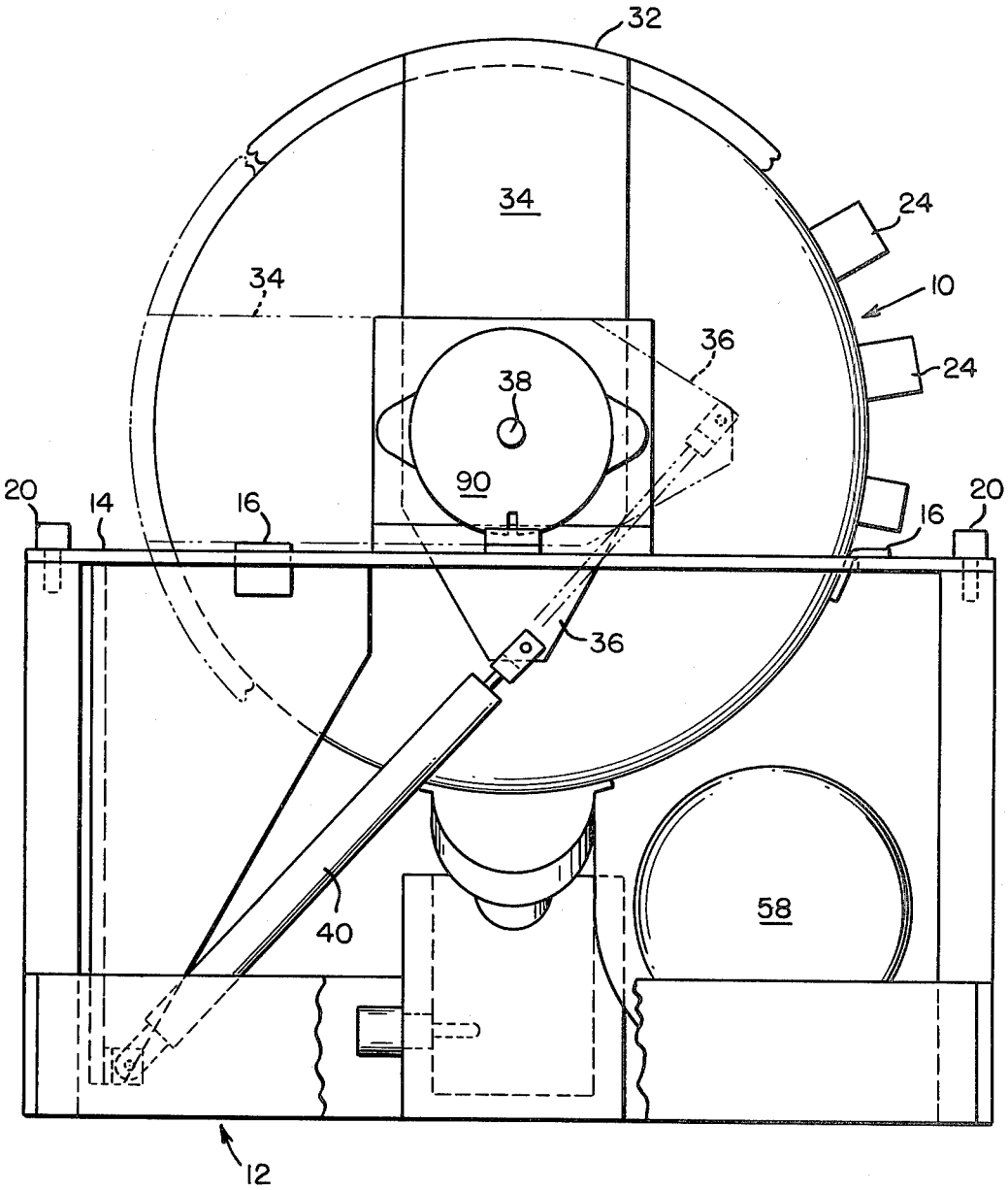
FIG. 4 is an end elevational view taken from the opposite end from that shown in FIG. 3, as seen on lines 4—4 of FIG. 1 and in the same enlarged scale as that shown for FIG. 3.

Referring to FIGS. 1 and 2, a preferred embodiment of the invention is illustrated with reference to an actual working apparatus which has been built by the owners of the rights in this application. In this embodiment, a stationary housing 10 constitutes the most visible portion of the apparatus. The housing 10 is generally in the shape of a cylindrical drum having flat ends, as seen also in FIGS. 3 and 4, and the housing is mounted on a base 12 which is fabricated to support the housing and to contain many of the working components associated with the operation of the apparatus. In the illustrated embodiment, the housing 10 is affixed to an upper support plate 14 of the base 12 with a series of brackets 16 secured between the housing 10 and the support plate 14. As shown in FIG. 1, the upper support plate 14 is pivoted at 18 to a lower portion of the base 12 so that the entire upper plate 14 and its contained housing 10 can be lifted (as shown by the partial dashed line position to the left of FIG. 1) for ease of servicing of component parts contained within the base of the unit. When the apparatus is not being serviced, the support plate 14 is secured to the lower portion of the base with manually operated fasteners 20.

The housing 10 functions as a treatment chamber in which a rotor assembly can be carried together with a load of semiconductor wafers which are to be treated within a special atmosphere or with a particular gases or liquids. Various treatments, such as washing, deionizing, drying, and etching can be carried out with apparatus of this type. Suitable connections are provided to supplies of gases or liquids for supplying appropriate treatment materials to the chamber defined within the housing 10, and a series of such connections are indicated generally at the positions 22 for receiving a liquid or gas and disbursing such liquid or gas to the interior of the housing through manifolds 24 associated therewith. The manifolds 24 and the way in which they are connected into the housing are well known in this art and do not form a separate part of this invention. In addition, a deionizing conduit 26 may be provided with a series of ports contained within manifolds 28 for communicating with the chamber defined within the housing 10.

One of the features of the present invention is to provide for a loading of a housing, of the type illustrated, through a top wall portion thereof so that loading may be carried out with automatic transfer line equipment if desired. To accomplish this, an access opening 30 is defined at the top of the housing 10, as seen in FIGS. 1 and 2. This access opening can be closed and sealed with a closure means 32 comprising a curved plate which matches the general outside contour of the housing 10 and which can be swung between positions which provide for a closing and sealing of the opening 30 to one which provides for a complete opening of the access opening 30. The closure means 32 includes mounting brackets 34 for supporting the closure means 32 and for securing the closure means to an actuating mechanism illustrated in FIG. 4. The actuating mechanism includes a plate 36 which can be swung about a horizontal axis 38 of the apparatus to, in turn, swing the support structures 34 and the closure means 32 to the dotted line position shown in FIG. 4. This is accomplished with a fluid pressure device 40 which is controlled in a known manner to provide for swinging motions of the closure means 32. The closure means 32 is mounted so as to clear the housing 10 without making actual contact with the housing while it is being moved between opened and closed positions. Once the closure 32 is in a closed position, an inflatable seal 42, arranged on the underside of the closure means 32 in a position which surrounds the opening 30, is inflated to effect a tight seal between the closure means 32 and the outer surface of the housing 10. Thus, there is provided a means for opening and closing a major access opening through the top of the stationary housing 10.

Figure 5:
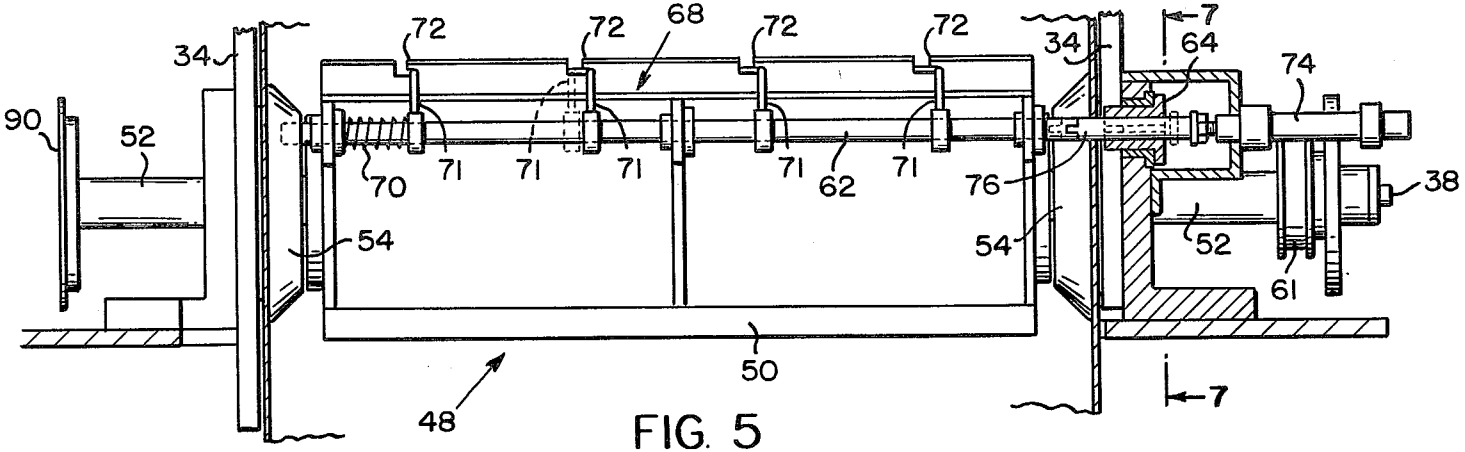
FIG. 5 is a side elevational view of a rotor assembly fitted within the apparatus of this invention.
Figure 6:
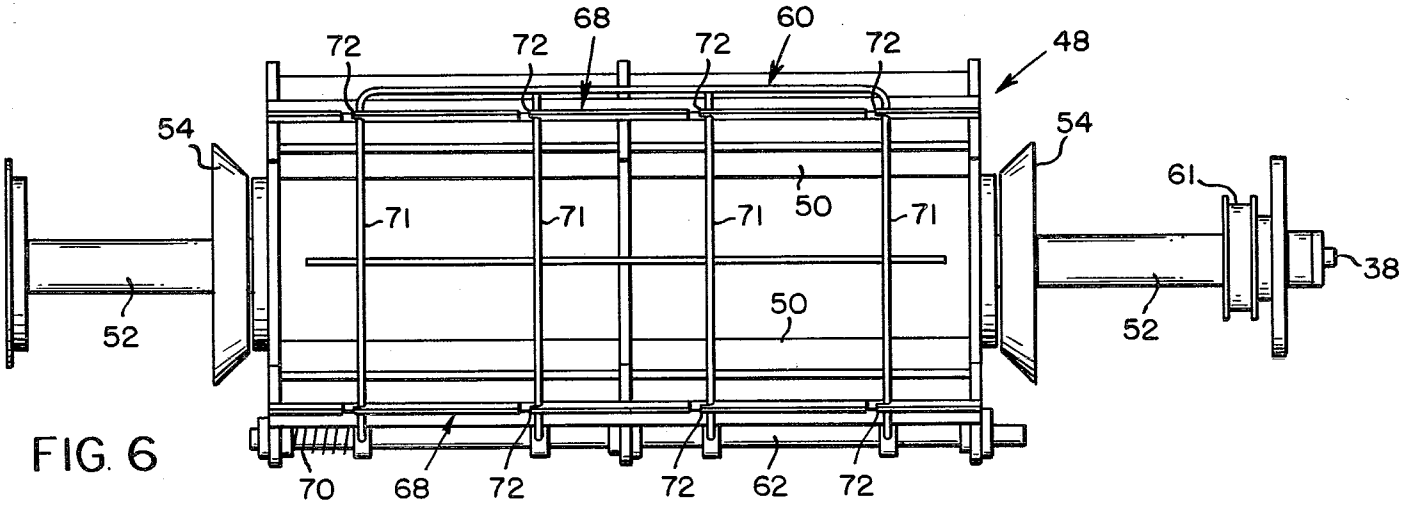
FIG. 6 is a top plan view of the rotor assembly shown in FIG. 5, drawn in somewhat of a reduced scale from that of FIG. 5.
Figure 7:
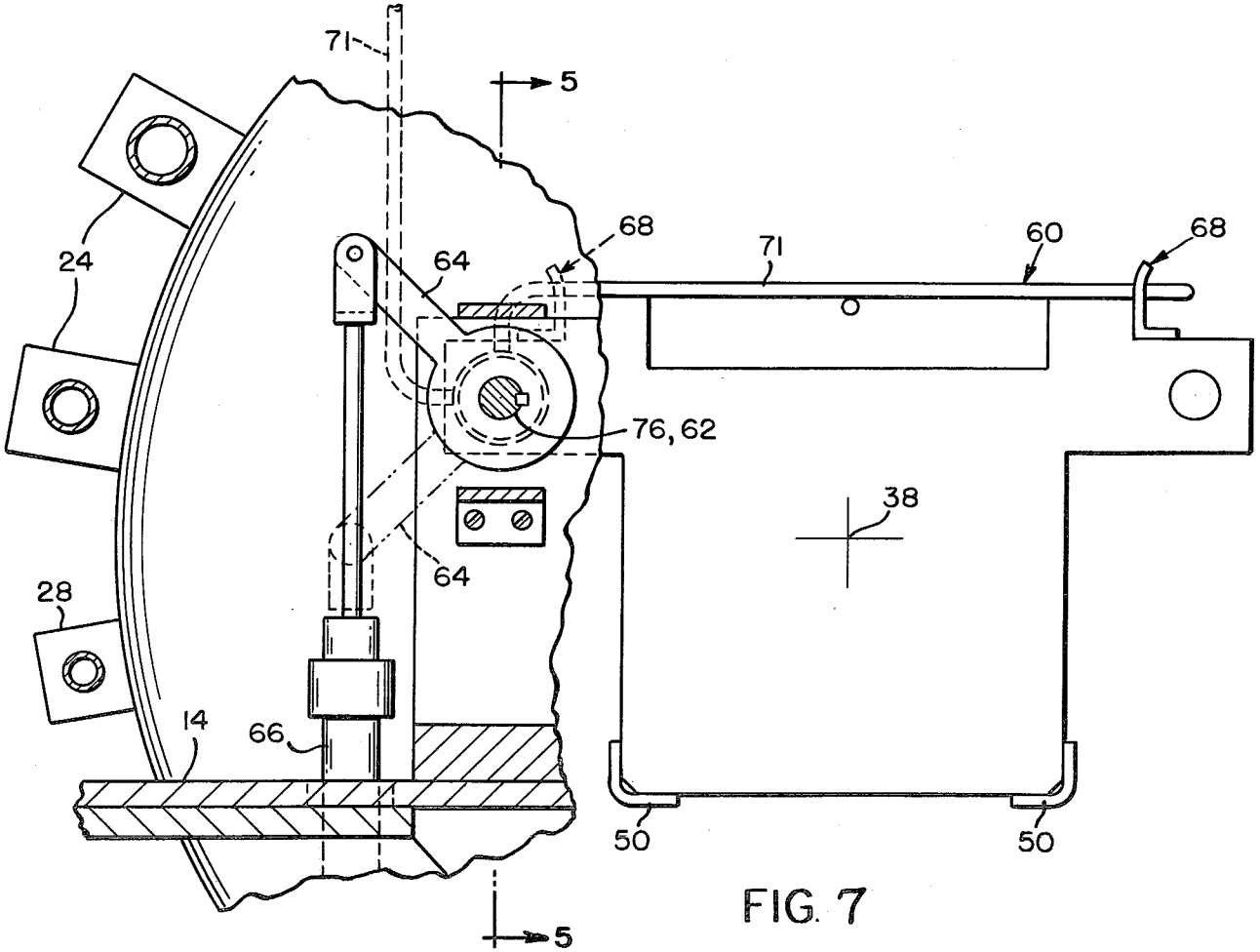
FIG. 7 is a greatly enlarged end view of an actuating mechanism associated with a closure means for the rotor assembly of FIG. 5.

Within the housing 10 is mounted a rotor assembly 48 of the type illustrated in FIGS. 5 through 7. As shown in FIG. 5, this rotor assembly is made up of framing members 50 which are shaped and dimensioned to define a rectangular container for receiving one or more standard sized carriers designed for holding silicon wafers during various handling and processing steps. The illustrated embodiment of FIG. 5 is designed to receive two separate carriers of silicon wafers, in an end to end relationship, within the generally rectangular frame of the rotor assembly 48. Axle stubs 52 are secured at each end of the rotor assembly for defining an axis of rotation 38 for the apparatus. Bearings and seals are provided around the axle stubs 52, as at 54, so that the rotor assembly is fully supported at each end and is mounted for rotation within the housing 10. Rotation is achieved with known driving means which includes a drive belt 56 (see FIGS. 1 and 3) for receiving driving moments from a drive motor 58, contained within the base of the apparatus and directly connected to a pulley 60 mounted on its output shaft. The driving moments are imparted to a pulley 62 mounted on an axle stub 52 associated with one end of the rotor assembly. Control means, with suitable circuits and programming arrangements, can be provided for turning the rotor assembly within the housing while the rotor assembly contains a load of wafers and while treatment gases or liquids are admitted to the chamber. The unit which is illustrated is capable of rotating at very high speeds, for example, up to 4000 revolutions per minute for certain treating and drying processes which are required for semiconductor wafers.

It can be appreciated that when the carriers of wafers are deposited into the frame of the rotor assembly 48, some means is required to retain the carriers and their contained wafers within the rotor while rapid rotation takes place. This is accomplished with a closure means 60 for the rotor itself. This closure means can be best seen in FIGS. 5 through 7 in which it is shown as a relatively open structure which permits an easy flow of gases or liquids into and out of the rotor for processing wafers contained therein. This relatively open structure can be formed from wire stock as illustrated in FIGS. 5 through 7, if desired.

A special means is provided for opening and closing the closure means 60 for the rotor assembly. Referring to FIG. 6, it can be seen that the closure means 60 generally covers the entire top of the rotor assembly and is mounted to pivot on an axis defined by a shaft 62. Referring to FIG. 7, the closure means is shown in a closed position in solid lines while shown in an open position with dashed lines. An actuating device consisting of a lever arm 64 actuated by a fluid cylinder 68 is connected to the shaft 62 for effecting pivotal movements of the closure means 60. When the closure means 60 is pivoted to a closed position, as shown in FIG. 7, a further feature of the invention provides for an automatic locking of the closure means into locking slots formed in a pair of parallel flanges 68 mounted on each side of the rotor assembly. As shown in FIG. 5, a spring device 70 normally urges the shaft 62 towards a locking position (towards the right in the FIG. 5 view) so that cross members 71 of the closure means 60 become engaged under portions 72 of the flanges 68. Unlocking of the closure means is accomplished with a fluid cylinder 74 which can be actuated to drive the shaft 62 into engagement with a slot formed in the end of the shaft 62 so as to overcome the spring 70 and to urge the closure 60 towards the left in the FIG. 5 view. This effects an automatic unlocking of the closure means 60, after which it can be rotated to an open position as described with reference to FIG. 7.

After a cycle of operations is completed, it is important to provide for a control means which guarantees the stopping of the rotor assembly 48 in a correct position for aligning its access opening with the access opening 30 of the housing 10. This is accomplished by mounting a control plate 80 on one of the axle stubs 52 of the rotor assembly for rotation therewith. The control plate 80 has a slot 82 formed into its surface for receiving a locking pin 84 when the locking pin 84 is advanced toward the control plate by a fluid operated device 86. With this arrangement, a processing cycle for the apparatus can be provided with a final rotation of the rotor which is very slow so that actuation of the locking pin 84 can take place and cause a stopping of the rotor in a position which correctly orients its load of wafers in an upwardly directed position for being unloaded from the housing 10.

Although the invention has been described with reference to basic structural components, it should be understood that additional features and controls can be included to provide for greater automation or control, or whatever. For example an optical counter 90 can be mounted for rotation with one of the axle stubs 52 so as to count revolutions of the rotor assembly. Also, circuitry can be provided for fully automatic opening and closing of the unit, rotation of the rotor at preferred speeds, and controlled admission of treating fluids. These and other variations are intended to be included within the scope of this invention as further defined in the claims below.

What is claimed is:

1. In apparatus for processing semiconductor wafers or similar disc-shaped objects in which a number of such wafers are arranged in a carrier supported within a rotor and which includes means for mounting the rotor within a housing for rotation on a generally horizontal axis, the improvement comprising a first access opening through a wall of said rotor which can be directed in a generally upward position for loading and unloading a carrier into and out of a supported position within the rotor, a first closure means for closing said first access opening and for retaining wafers within said carrier while the wafers are being processed, a second access opening through a wall of said housing for providing entry to said rotor within said housing, a second closure means for closing and sealing said second access opening, and control means associated with a means for driving and rotating said rotor for stopping the rotor, at the end of each processing cycle, in a position which aligns said first access opening of the rotor with said second access opening of said housing, to thereby provide for movement of carriers into and out of said rotor when said first and second closure means are opened.

2. The apparatus of claim 1 wherein said first closure means is a relatively open structure which permits an easy flow of gases or liquids into and out of said rotor for processing said wafers.

3. The apparatus of claim 2 wherein said closure means includes a frame which is mounted on a pivot axis so that the closure means can be pivoted between open and closed positions relative to said rotor.

4. The apparatus of claim 3, and including means for moving said frame axially along said pivot axis between positions which lock and unlock said closure in its closed position.

5. The apparatus of claim 4 wherein said means for moving said frame axially comprises a spindle member which can be advanced along said pivot axis into contact with said frame for moving the frame axially to an unlocked position, and wherein said spindle member further includes a connecting element for connecting the spindle member to said frame while the spindle member is rotated, to thereby impart pivoting opening and closing movements to the frame.

6. The apparatus of claim 2 and including control circuitry and a program for dictating a processing cycle for the apparatus, and wherein said circuitry and program provide for (a) a very slow rotation of said rotor at the end of each cycle and (b) an actuation of said locking pin during the period of very slow rotation so that the locking pin can enter said opening in said control plate and stop all rotation of the rotor at the end of the processing cycle.

7. The apparatus of claim 1 wherein said control means includes a control plate mounted for rotation with the rotation of said rotor means, said control plate having an opening formed therein for receiving a locking pin when the control plate and said rotor are in positions for aligning said first and second access openings, and including a locking pin which can be actuated to a locking position within said opening of the control plate when a processing cycle has been completed.

8. The apparatus of claim 1 wherein said rotor has axle portions extending from opposite ends thereof on a common axis which is the axis of rotation for the rotor, and including bearing support means associated with each axle portion for supporting the load of the rotor and its contents while it is being rotated.

9. In apparatus for processing semiconductor wafers, or similar disc-shaped objects, which are arranged in a carrier supported within a rotor, the improvement comprising a housing for containing said rotor while the rotor is being rapidly rotated to carry out a treatment of said wafers, said housing having an access opening through a top wall thereof to provide access to the rotor therethrough, and a closure for closing and sealing said access opening through the housing, retaining means associated with said rotor for retaining wafers within the rotor while it is rotated rapidly on a generally horizontal axis, said retaining means comprising a relatively open closure device which can be pivoted between open and closed positions relative to the rotor, and including means for automatically locking said retaining means when it is in a closed position, and driving means for said rotor which includes means to stop said rotor in a position which provides easy access to the wafer in said rotor, whereby the rotor can be easily unloaded and reloaded.

* * * * *